United States Patent [19]

Singer

[11] Patent Number: 4,477,291

[45] Date of Patent: Oct. 16, 1984

[54] METAL-COATING A METALLIC SUBSTRATE

[75] Inventor: Alfred R. E. Singer, Swansea, Wales

[73] Assignee: National Research Development Corporation, London, England

[21] Appl. No.: 585,148

[22] Filed: Mar. 1, 1984

[30] Foreign Application Priority Data

Mar. 9, 1983 [GB] United Kingdom ..... 8306428

[51] Int. Cl.[3] ..... B05D 3/00

[52] U.S. Cl. ..... 148/11.5 Q; 148/6.35; 427/320; 427/328; 427/319; 427/422

[58] Field of Search ..... 427/319, 328, 422, 320; 148/6.35, 11.5 Q

[56] References Cited

U.S. PATENT DOCUMENTS 3,959,030 5/1976 Satake ..... 427/328

4,333,755 6/1982 Mahrees ..... 148/11.5 Q

*Primary Examiner*—Sam Silverberg

*Attorney, Agent, or Firm*—Cushman, Darby & Cushman

[57] ABSTRACT

Aluminium is coated on steel strip. The steel strip is heated in hydrogen to reduce surface oxides to iron, and is then sprayed at 400° C. with nitrogen-atomized molten aluminium to a depth of 150 microns. Still in nitrogen/hydrogen, at 350° C., the coated strip is rolled. Under these conditions, the aluminium is subjected to very high compressive stress (compared with its yield stress) while the steel does not even reach its yield stress.

2 Claims, No Drawings

METAL-COATING A METALLIC SUBSTRATE

This invention relates to a method of coating a metallic substrate with a metal, and to the coated product.

The metal which may be coated on any given substrate is subject to various restrictions, as will become apparent later, but examples to which the invention can apply are aluminium-coated steel, zinc-coated steel and aluminium/zinc-coated steel. The substrate (steel in these examples) may be a strip, which may pass continuously through the stages of the method according to the invention, as will become clearer.

A popular known method of coating a substrate is hot-dipping, which is widely used for producing galvanised steel strip, aluminium-coated steel strip and aluminium/zinc-coated steel strip. In that method, the steel strip is cleaned, heated in a reducing atmosphere and then passed, at a temperature now only slightly above the melting point of the coating metal (or alloy) and then passed rapidly through a bath of molten coating metal. A thin film of the coating metal is dragged out of the bath on the strip and quickly solidifies. The process is cheap but (especially with zinc) gives a poor, often spangled, surface appearance together with reduced ductility of the coating. With both aluminium and zinc, considerable diffusion occurs at the interface leading to formation of a brittle alloy layer and/or brittle intermetallic compounds. Although these imply good adhesion of the coating, if the product is bent, they crack and expose the steel to corrosion.

According to the invention, a method is provided of coating a metallic substrate with a metallic coatant, wherein the coatant metal (or alloy) is one which wets the substrate metal and wherein the substrate metal (or predominant substrate metal) is one whose oxide is reducible below its solidus temperature, which solidus temperature must exceed the liquidus temperature of the coatant metal, the method comprising heating the substrate in a reducing atmosphere until substantially no oxide remains on it, then, without permitting intervening oxidation, maintaining the substrate in a reducing or neutral atmosphere at from 0.5, preferably at least 0.55, more preferably at least 0.6, to 0.9 (preferably 0.85) of the liquidus temperature (in degrees absolute), and spraying molten coatant thereon to a thickness not exceeding 150 microns or sequentially spraying two or more coatings each not exceeding 150 microns, then, without permitting intervening oxidation, maintaining the sprayed substrate in a reducing or neutral atmosphere, at a temperature which (i) is at least 0.5, preferably at least 0.55, more preferably at least 0.6 of the solidus temperature of the coatant in degrees absolute, (ii) is less than 0.9 (preferably not exceeding 0.85) of the liquidus of the coatant and (iii) is such that the coatant at that temperature has a yield stress of at most half (preferably at most 0.2) that of the substrate, and rolling the sprayed substrate to strain the substrate by at most 2% but sufficiently to ensure substantially complete consolidation of the coatant. This implies a reduction in thickness of the sprayed coating which is commensurate with the porosity of the coating and the roughness of its surface.

It will be appreciated that this hot-rolling will consolidate the coating internally and also create an external surface free from crevices and of minimal roughness, while causing a trivial (or nil) overall rolling reduction or extension of the substrate. Moreover, since the coatant is solid at the time of rolling, the compressive stress applied by the roll to the coating cannot be dissipated by flow of the coating parallel to the substrate/coating interface, such flow being inhibited by friction with the rolls. The stress at which such flow would start is known as the "constrained yield stress". The high compressive stress caused by the inhibition of the flow applies large densification forces to the coating while scarcely straining the substrate.

If the rolling temperature is too low, the coating will need higher pressures for densificiation which will cause unacceptable extension of the substrate and, the coating being subject now to cold-working (not hot-working), it will not readily become coherent and, if the product is bent, the coating will decohere, thus exposing the substrate.

Reverting to the spraying step, each droplet forms a splat on the substrate and freezes, but, while molten, starts to wet the substrate. If freezing precedes wetting (at low substrate temperatures) the coating will not adhere, whereas if wetting precedes freezing (at higher substrate temperatures) adhesion is good. However, above a certain limiting temperature, diffusion of the coatant and substrate into each other becomes so large as to cause interfacial embrittlement. The substrate temperature range specified herein is intended to be sufficiently high for wetting to precede freezing yet not so high as to promote excessive diffusion, in other words is intended to encourage good adhesion of the coating to the substrate.

If oxygen is allowed into the system, adhesion and cohesion of the coating will both be poor, leading to failure in service.

Preferably, the steps of spraying and rolling are both performed in the same atmosphere.

The invention will now be described by way of example.

A low-carbon steel strip 1¼ mm thick was uncoiled, degreased and led through a gas-tight seal into a chamber containing hydrogen and held at 750° C. to reduce superficial oxides on the strip to iron. The strip was then passed through baffles out of the hydrogen chamber into a nitrogen-containing chamber. The strip in this chamber was held at a temperature of 400° C. while nitrogen-atomised molten aluminium (700° C.), mean particle size around 80 microns, was sprayed onto the strip to a thickness of 50 microns (one-twentieth of 1 mm). The strip from here onwards is thus surrounded by an atmosphere composed mainly of nitrogen from the atomising plus some hydrogen from the previous chamber. Oxygen is excluded. As the strip continues it cools to 350° C., that is, within the cold-working temperature range of the steel but within the hot-working range of the aluminium. The coated strip was passed between rolls ½ m in diameter. In these circumstances, the "constrained yield stress" (explained earlier) of the aluminium will be approximately 9 times the normal un-constrained yield stress of aluminium at that temperature, assuming reasonable values for roll friction. With smaller roll diameters, the constrained yield stress of the aluminium falls, being as low as 1.5 times the unconstrained yield stress with 50 mm diameter rolls. This means that with the ½ m rolls the aluminium will be subjected to very high compressive stresses, far higher than its normal yield stress, while not even reaching the yield stress of the steel substrate. The aluminium will therefore be heavily compacted within its hot-working temperature range with consequent improvement of both the cohesion of the coating and its adhesion to the substrate. As a result, the coated product has a smooth and more uniform surface and a greatly improved ability to be bent without failure of the coating. Only after this rolling is air (oxygen) allowed to contact the product.

A thinner coating can be applied if desired, and if so, the particle size of the atomised coatant should not greatly exceed the desired coating thickness.

If lead-coated steel is required, since lead does not wet iron, lead alloyed with a proportion of tin may be used, as such an alloy will wet iron.

I claim:

1. A method of coating a metallic substrate with a metallic coatant, wherein the coatant metal (or alloy) is one which wets the substrate metal and wherein the substrate metal (or predominant substrate metal) is one whose oxide is reducible below its solidus temperature, which solidus temperature must exceed the liquidus temperature of the coatant metal, the method comprising:

heating the substrate in a reducing atmosphere until substantially no oxide remains on it, then, without permitting intervening oxidation, maintaining the substrate in a reducing or neutral atmosphere at from 0.5 to 0.9 of the liquidus temperature (in degrees absolute), and spraying molten coatant thereon to a thickness not exceeding 150 microns or sequentially spraying two or more coatings each not exceeding 150 microns, then, without permitting intervening oxidation, maintaining the sprayed substate in a reducing or neutral atmosphere at from 0.5 to 0.9 of the liquidus temperature of the coatant, the temperature moreover being such that the coatant has a yield stress of at most half that of the substrate, and rolling the sprayed substrate to strain the substrate by at most 2% but sufficiently to ensure substantially complete consolidation of the coatant.

2. A method according to claim 1, wherein the steps of spraying and rolling are both performed in the same atmosphere.

* * * * *